US012677934B1

(12) United States Patent
James

(10) Patent No.: US 12,677,934 B1
(45) Date of Patent: Jul. 14, 2026

(54) TOOTHBRUSH ARTICLE WITH DISPENSER FOR DENTAL HYGIENE PRODUCTS

(71) Applicant: Nicole James, Miramar, FL (US)

(72) Inventor: Nicole James, Miramar, FL (US)

( * ) Notice: Subject to any disclaimer, the term of this patent is extended or adjusted under 35 U.S.C. 154(b) by 0 days.

(21) Appl. No.: 17/220,413

(22) Filed: Apr. 1, 2021

Related U.S. Application Data

(60) Provisional application No. 63/003,315, filed on Apr. 1, 2020.

(51) Int. Cl.
*A46B 11/00* (2006.01)
*A46B 5/00* (2006.01)

(52) U.S. Cl.
CPC ..... *A46B 11/0041* (2013.01); *A46B 5/0095* (2013.01); *A46B 11/0065* (2013.01); *A46B 2200/1066* (2013.01)

(58) Field of Classification Search
CPC ..... B65D 2577/043; B65D 77/048; B65D 81/3288; B65D 83/0055; A46B 11/0072; A46B 11/0041; A46B 11/0065; A46B 2200/1066; A46B 5/0095; A46B 11/4041
USPC ..... 15/167.1, 145; 401/280, 123
See application file for complete search history.

(56) References Cited

U.S. PATENT DOCUMENTS 3,876,112 A * 4/1975 Kramer ..... B65D 1/04 222/144.5
4,049,354 A 9/1977 O'Rourke
4,116,570 A 9/1978 Parenti
4,277,194 A 7/1981 Smith
5,028,158 A 7/1991 Fey
5,137,178 A * 8/1992 Stokes ..... B65D 35/22 D9/695
6,056,466 A 5/2000 Johnson et al.
7,128,492 B1 10/2006 Thames, Jr.
8,387,628 B2 3/2013 Bowie
8,496,393 B2 7/2013 Martin et al.
8,534,950 B2 9/2013 Sylvester
9,339,103 B1 5/2016 Watters
10,021,963 B2 7/2018 Johnson
10,029,822 B2 * 7/2018 Kinney ..... B65D 43/0225
2003/0215282 A1 11/2003 Edwards et al.
2004/0057773 A1 3/2004 Gray
(Continued)

FOREIGN PATENT DOCUMENTS

GB 2307674 A * 6/1997 ..... A46B 11/0041

*Primary Examiner* — Katina N. Henson
(74) *Attorney, Agent, or Firm* — John Rizvi; John Rizvi, P.A.—The Patent Professor®

(57) ABSTRACT

A toothbrush assembly includes a toothbrush implement and a receptacle unit removably connected together. The receptacle has a hollow body construction that is configured to include a partition that divides the interior space into a front compartment that holds a toothpaste tube and a rear compartment that stores mouthwash. A removable lid covers the open free end of the receptacle. On one side, the lid has an orifice that receives the nipple of the toothpaste tube loaded into the front compartment. On another side, the lid has a nipple projection that is disposed in fluid communication with the rear compartment. A front sidewall of the receptacle body has an opening that communicates with the front compartment. A resilient pad fits over the opening and can be depressed to apply a squeezing action to the loaded toothpaste tube and cause toothpaste to be dispensed from its nipple.

9 Claims, 11 Drawing Sheets

(56) References Cited

U.S. PATENT DOCUMENTS

| | | | | |
|---|---|---|---|---|
| 2008/0149126 | A1* | 6/2008 | Abergel | B65D 81/3288 401/35 |
| 2008/0219751 | A1 | 9/2008 | Teitelbaum | |
| 2010/0284726 | A1* | 11/2010 | Ottaviani | A46B 11/0079 401/268 |
| 2013/0251438 | A1 | 9/2013 | Vila | |
| 2015/0296970 | A1* | 10/2015 | Kennedy | B01F 27/092 401/271 |
| 2018/0020807 | A1* | 1/2018 | Villarreal | B05B 11/3015 401/183 |
| 2019/0116968 | A1 | 4/2019 | Curry | |

* cited by examiner

TOOTHBRUSH ARTICLE WITH DISPENSER FOR DENTAL HYGIENE PRODUCTS

CROSS-REFERENCE TO RELATED APPLICATIONS

This application claims the benefit of U.S. Provisional Patent Application Ser. No. 63/003,315, filed Apr. 1, 2020, which is hereby incorporated herein by reference in its entirety.

FIELD OF THE INVENTION

The present invention relates generally to dental devices, and more particularly, to a combination including a toothbrush implement assembled with a container facility that stores and dispenses dental hygiene products such as toothpaste and mouthwash.

BACKGROUND OF THE INVENTION

American health care is infamously regarded as one that fails to cater to those that require its help the most, leading to wide-ranging dislike of the system. Such dislike proves a motivating factor in the distancing of some patients from treatment, but oftentimes these treatments are necessary for the patient's longevity. In the United States alone, it was reported that in 2013, 15.9% of all adults reported not seeing a physician for an entire year because of its cost-a total of over 50 million Americans. Also in 2016, the United States Census Bureau reported that the percentage of people with health insurance coverage for all or part of the year was 91.2, meaning that even some who were insured decided to forego doctor visits due to its cost.

This problem is exacerbated in regard to dental care, since millions less receive dental coverage as part of their health care plan. According to the National Association of Dental Plans, about 74 million Americans had no dental coverage in 2016, making it likely that the number of visits to a dentist was much lower than to a physician during that time period. In fact, the American Dental Association reported that approximately 22.9 percent of adults indicated that they are either unsure or definitely do not plan to visit a dentist in the next 12 months. By a large margin, those that do not intend on visiting a dentist include low-income adults without health insurance. Their top reasons for forgoing dental care include cost, deciding they do not need it, and not having the time.

Dental care might not be viewed as important as other aspects of health care, but statistics from the same source show that Americans who receive no dental care coverage are more likely to have heart disease, osteoporosis, and even diabetes. These higher incidences of illness probably arise from their refusal to pay the expensive cost of preventative care, of which the benefits are not easily discernible. However, skipping preventative care will only lead to complications in the future, where the individual will instead have to pay a higher price for the treatment while suffering the health consequences.

In fear of paying for a dentist's visit and accruing health complications in the future, some tend to care more for their dental health that others. This seemingly beneficial side effect inspires individuals to brush their teeth more often, use mouthwash frequently, floss regularly, and make sure they are well versed in all aspects of dental care. However, the problem persists in relation to children. For them, brushing their teeth is a chore they would rather avoid, and if the parent is not involved, it is a task effortlessly bypassed. Without understanding the long term physical and financial consequences of foregoing proper dental care routine, children tend to ignore it.

Attempts at making dental care appealing to children have been implemented but are not as successful as they could be. In addition, such attempts do not directly target dental care, but are used as a distraction to make the ordeal tolerable. For example, the American Dental Association recommends converting teeth brushing time into an event by introducing music or reading a short story. They also recommend creating a routine out of dental care, such that the child incorporates it into their daily lives. Although these are sensible recommendations, none of them really captivates the child to initiate dental care on their own.

One of the current methods to make children want to practice dental care is by making toothpaste taste better. Although this has shown some promise, it has not solved the issue completely, as there are still plenty of children who do not desire to partake in dental care, despite toothpaste flavor. This may also erroneously signal the children that it is okay for the candy-flavored toothpaste to be swallowed, potentially introducing a hazardous scenario.

Therefore, there is an unmet need for a manner in which to attract children, and possibly some adults, to actively practice proper dental care and avoid the aforementioned health complications that may arise. The cost of dental care is prohibitive and the most effective way avoid overwhelming expenses is through preventative care. Accordingly, there is an established need for a toothbrush article that is able to conveniently furnish the user with a replenishable supply of dental hygiene products such as toothpaste and mouthwash, items that are made available in a single integrated package or unit along with the toothbrush implement that is attractive to children and adults alike.

SUMMARY OF THE INVENTION

The present invention is directed to a toothbrush assembly including a toothbrush implement and a receptacle unit. The toothbrush implement defines a top part of the assembly, while the receptacle unit defines a bottom part. The top and bottom parts are removably connected together in an end to end configuration, such as a releasable press fit connection or attachment. The receptacle has a hollow body, generally tubular construction that is configured to include an axially extending partition that divides the interior space of the hollow body into a front compartment adapted to hold and support a toothpaste tube and a rear compartment adapted to store a fluid such as mouthwash. The receptacle body has an open upper end and a closed lower end. A removable lid covers the open, upper free end of the receptacle. On one side, the lid has an orifice that receives the nipple of the toothpaste tube once loaded into the front compartment. On another side, the lid has a nipple projection that is disposed in fluid communication with the rear compartment. The combination of the lid, partition, and receptacle body cooperatively and integrally forms a closed receptacle (the rear compartment space) to hold fluid contents. A front sidewall of the receptacle body has an opening that communicates with the front compartment. This opening directly opens into the front compartment. A resilient front pad fits over the opening and defines an intimate clearance space with the loaded toothpaste tube. During use, the front pad can be depressed to apply a squeezing action to the loaded toothpaste tube and cause toothpaste to be dispensed from its nipple.

Introducing one embodiment of the invention, the present invention consists of an assembly, comprising:

a top part and a bottom part releasably connected together in a mating relationship;

the top part including a toothbrush implement;

the bottom part including:

an elongate hollow body having an open upper end and a closed lower end, the body defining an interior space, the body having a front half sidewall and a rear half sidewall, a partition disposed in the hollow body and dividing the interior space into a tube-receiving front compartment space and a fluid-receiving rear compartment space, an opening formed in the front half sidewall and communicating with the front compartment space, and a lid removably located on the bottom part body at the upper end thereof, the lid including a front section having a nipple-receiving aperture disposed in communication with the front compartment space, the lid including a rear section having a nipple projection disposed in communication with the rear compartment space.

In another aspect of the present invention, the toothbrush implement includes a head and a shank extending from the head, wherein the shank has a bottom free end.

In another aspect, the bottom free end of the shank further includes a terminal peripheral bottom edge having a recess formed therein.

In another aspect, the open upper end of the bottom part body includes a terminal peripheral upper edge having a peripheral lip projecting therefrom.

In another aspect, the top part and the bottom part are connected together by seating the lip projecting from the terminal peripheral upper edge of the open upper end of the bottom part body within the recess formed in the terminal peripheral bottom edge of the bottom free end of the toothbrush implement shank.

In another aspect, the lid is disposed at a location generally concentric and radially inward of the lip projecting from the terminal peripheral upper edge of the open upper end of the bottom part body.

In another aspect, the bottom part body is configured to receive and support a toothpaste tube in a manner such that a nipple of the toothpaste tube extends through the nipple-receiving aperture of the lid.

In another aspect, the assembly further includes a bottom front grip feature carried by the bottom part body and disposed over the opening formed in the front half sidewall.

In another aspect, the bottom front grip feature is configured to define an intimate spaced-apart relationship with a toothpaste tube operably loaded into the tube-receiving front compartment space such that depression of the bottom front grip feature facilitates contact with the toothpaste tube.

In another aspect, the combination of the lid at the rear section thereof, the partition, and the rear half sidewall of the bottom part body is configured to define the rear compartment space as a fluid-tight receptacle.

In another aspect, the partition is configured at an upper end thereof to support the lid.

In another aspect, the partition extends axially from the closed lower end of the bottom part body and is generally coplanar with a coronal plane of the bottom part body.

In another aspect, the assembly further includes a top grip feature annular disposed about the toothbrush implement shank and a bottom rear grip feature disposed at the rear half sidewall of the bottom part body.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
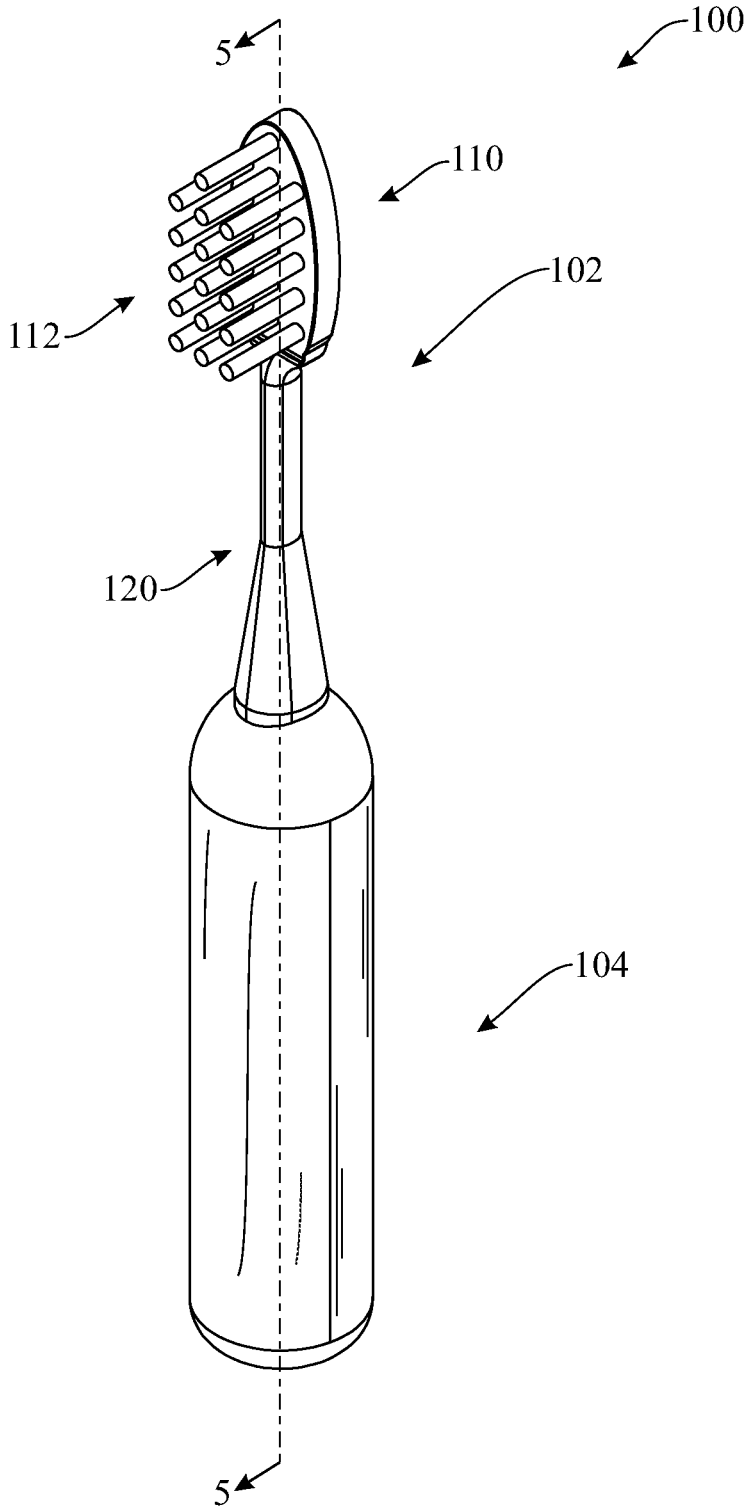
FIG. 1 presents a front perspective view showing a first embodiment of the toothbrush article of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a mechanical-type dental appliance that integrates a toothbrush implement with a receptacle unit. The toothbrush implement forms the head or top, upper portion of the dental appliance, while the receptacle unit forms the main body or bottom, lower portion. The receptacle unit stores and makes available for dispensing a variety of consumable hygiene products or commodities (such as toothpaste and mouthwash), which are contained in the receptacle unit. The receptacle unit is removably connected to the toothbrush implement to facilitate dispensing of the stored items. The receptacle unit has a refillable feature, enabling the commodity storage spaces of the receptacle unit to be replenished with the relevant hygienic material or substance.

Referring to FIGS. 1-7, a first embodiment of the present invention is disclosed. According to one exemplary implementation of the first embodiment, an assembly comprises, in combination, a toothbrush implement including a head and a shank extending from the head, the shank having a free end; and, a receptacle removably connected to the toothbrush implement at the free end of the shank, the receptacle defining at least one interior compartment space each having at least one of a respective supply inlet and a dispenser outlet. The present invention, according to one form of the first embodiment, is directed to an all-in-one toothbrush assembly or article that combines the functionality of a toothbrush with the provision of various consumable resources that typically accompany the teeth cleaning process, such as toothpaste and mouthwash. The assembly includes a toothbrush device or apparatus in combination with a receptacle unit. The toothbrush device includes a head and a shank supporting the head. The head includes a set of brushing bristles. The receptacle unit is removably connected to the toothbrush device at a free end of the shank. The connection between the components can be made using a male-female fastener or fitting. For example, the free end of the shank can be adapted to define a threaded female portion, while the receptacle unit can be adapted at a connection end with a threaded male projection that threadedly engages the female portion integral with the shank, thereby fastening the toothbrush device to the receptacle unit. The receptacle unit includes an elongate body having at least a partially hollowed out interior. In particular, the body of the receptacle unit defines an interior space configured into at least one isolated compartment space each adapted to store and otherwise contain a replenishable substance such as toothpaste or mouthwash. Each compartment space includes an inlet and an outlet. The inlet serves as a supply port through which the compartment space can be refilled or replenished with the storage substance. The outlet serves as a dispensing port through which the substance contained in the compartment space can be dispensed and otherwise discharged for use and consumption by the toothbrush user.

Figure 2:
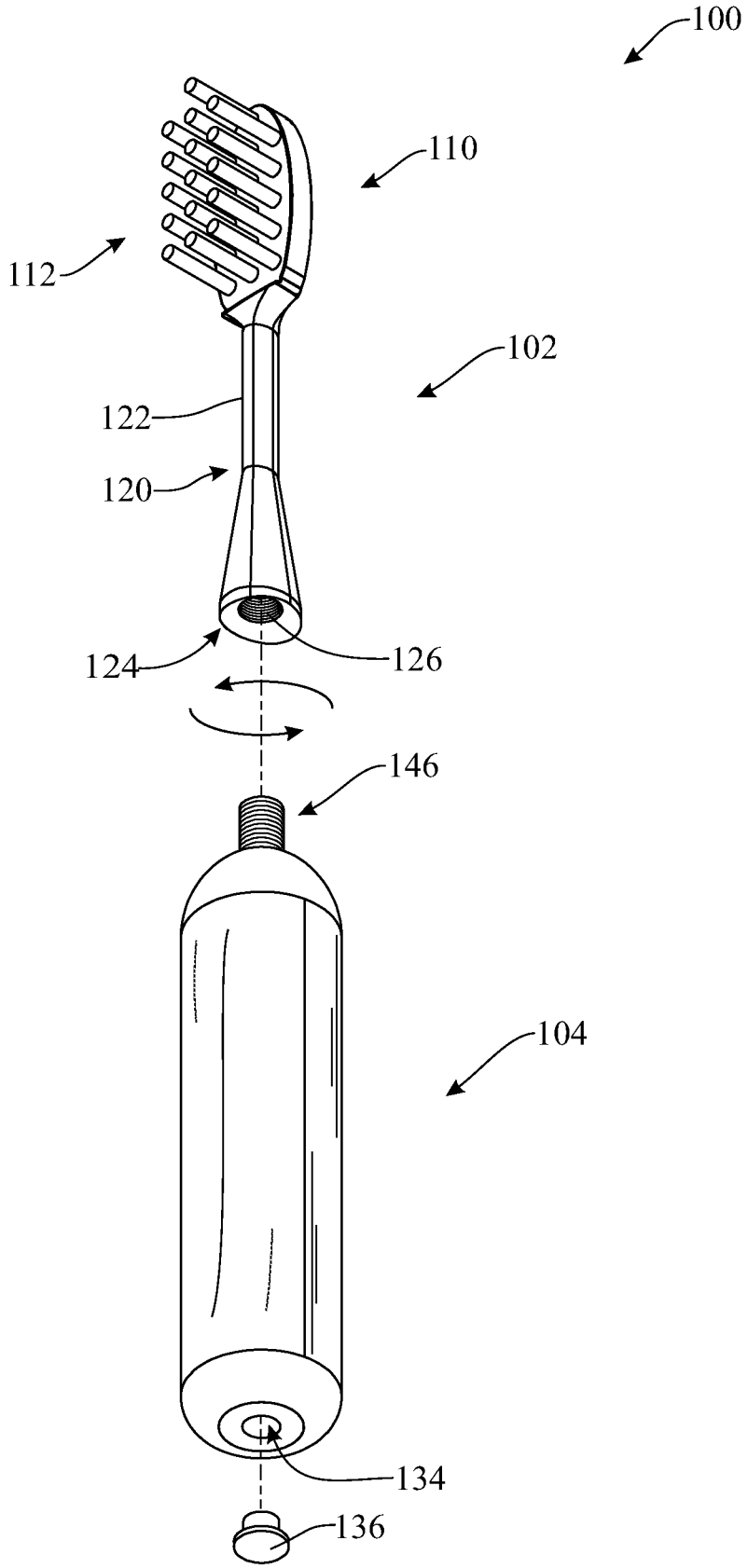
FIG. 2 presents a disassembled front, lower perspective view of the first embodiment of the toothbrush article of the present invention, showing the separation of the upper portion from the lower portion.
Figure 5A:
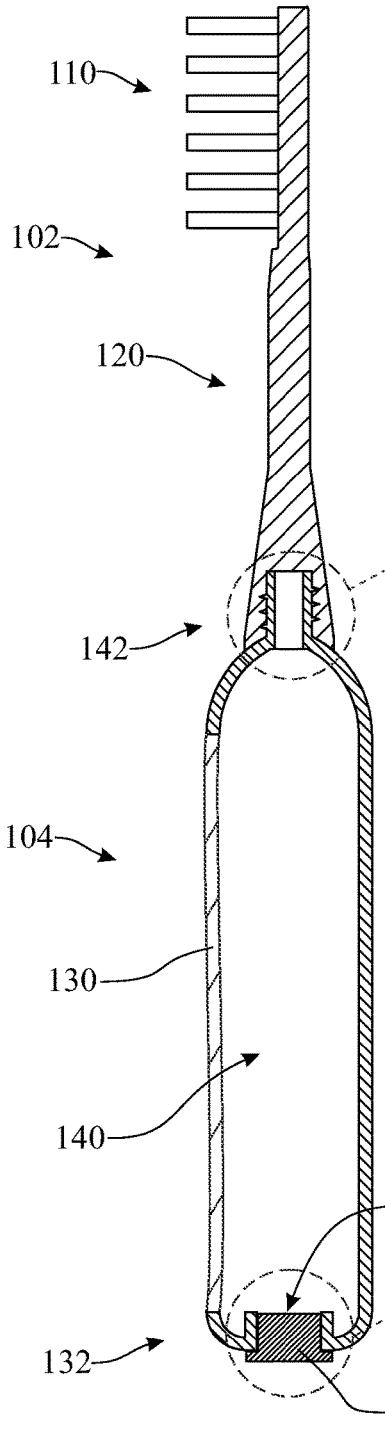
FIG. 5*a* presents a cross-sectional view of the first embodiment of the toothbrush article of the present invention taken along lines 5-5 of FIG. 1, illustrating in a series of enlarged, caption views (FIGS. 5*b* and 5*c*) the arrangement of inlet and outlet ports for an exemplary compartment space designed to contain a consumable dental product, and the manner of removably connecting the separable components of the two-piece article by a threading engagement.
Figure 5B:
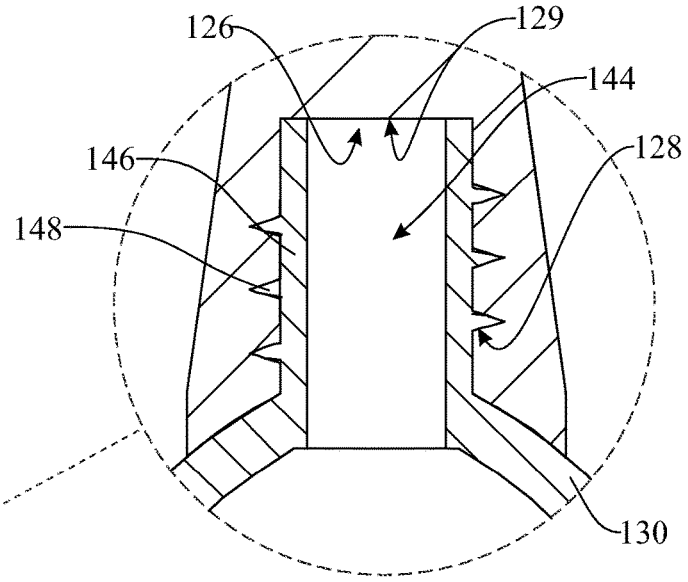
Figure 5C:
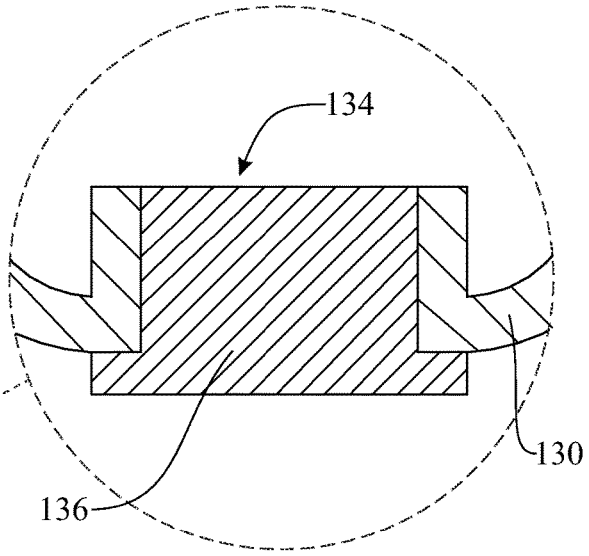

Referring initially to FIGS. 1, 2 and 5, there is shown a dental hygiene appliance or article in the form of a toothbrush assembly 100 that includes, in integral combination, a toothbrush implement 102 and a receptacle unit or canister 104, according to the first embodiment of the present invention. As discussed further, one feature of assembly 100 is that canister 104 stores and otherwise contains one or more dispensable substances or materials suitable for use as a hygiene product or commodity, such as toothpaste or mouthwash. Another feature of assembly 100 is that canister 104 is removably coupled to toothbrush implement 102 to define a separable two-piece configuration, enabling the components to be separated so that the contents of canister 104 can be more readily and conveniently dispensed for consumption and use. In this regard, assembly 100 has the form of a modular device or apparatus in which either or both of toothbrush implement 102 and canister 104 can be interchangeable and replaced with a compatible unit having a similar functionality. For example, implement 102 can be exchanged for another type of toothbrush construction. Additionally, canister 104 can be exchanged for another such unit having a different content profile or characteristic.

The toothbrush implement 102 includes a head 110 mounted to a shank 120 in an integral one-piece construction. The head 110 includes an arrangement of bristles 112 in a conventional construction. The shank 120 has a generally narrow elongate body 122 suitable for a toothbrush application. The body 122 of shank 120 has a free end 124 where coupling is made to canister 104, as discussed further. The free end 124 of shank 120 defines the lower end of toothbrush implement 102. In the assembled form of toothbrush assembly 100, canister 104 can serve as a handle or grip for the user to grasp and maneuver in order to execute a teeth cleaning process using toothbrush implement 102.

Canister 104 functions as a refillable container or receptacle to store and selectively dispense one or more consumable items or resources, such as any substance, material, product or commodity conducive to dental hygiene, according to one feature of the present invention. For example, canister 104 may store toothpaste and/or mouthwash. Canister 104 has an elongate, generally cylindrical or tubular body 130 that defines at least one hollow interior space configured as an internal compartment or chamber (cavity) 140 for holding and dispensing contents stored therein. In particular, compartment 140 functions to receive, store, and dispense a hygiene product or other suitable material, based on user preference, selection, and control. The body 130 of canister 104 is adapted at a lower end 132 with an orifice, inlet or supply port 134 that is disposed in communication with compartment 140. The supply port 134 serves as the access way or input means by which a substance can be supplied into compartment 140 in order to fill canister 104 with relevant desired contents. The supply port 134 can be fitted with a suitable removable plug 136 to provide a sealing action and to prevent the contents inside compartment 140 from escaping or spilling/leaking out. Any suitable form and structure known to those skilled in the art can be used to configure and construct supply port 134 and plug 136. The body 130 of canister 104 is adapted at an upper end 142 with an orifice, outlet or dispensing port 144 that is disposed in communication with compartment 140. The dispensing port 144 serves as the output channel or pathway through which the contents of compartment 140 are dispensed, when canister 104 is disconnected from toothbrush implement 102.

The coupling of toothbrush implement 102 to canister 104 employs a type of selectively adjustable fitting that incorporates a combination of male and female features, according to an aspect of the present invention. In one exemplary implementation, canister 104 is configured with a male fitting or fastener, while toothbrush implement 102 is configured with a female fitting that is complementary and mateable to the male fitting of canister 104. In particular, the lower free end 124 of shank 120 of toothbrush implement 102 is adapted to define an axially extending recess or female-type fitting 126 provided with a set of internal threads 128. In a compatible configuration, the upper end 142 of body 130 of canister 104 is adapted to define an axially extending cylindrical projection or hollow male-type fitting 146 that is provided with a set of external threads 148 at its outer surface. The threaded female fitting 126 of toothbrush implement 102 is complementary and mateable with the threaded male fitting 146 of canister 104. The toothbrush implement 102 and canister 104 are assembled together into a one-piece unit by facilitating a threaded engagement between the threaded male fitting 146 at the upper end 142 of canister 104 and the threaded female fitting 126 at the lower free end 124 of toothbrush implement 102. An alternate fastening configuration is also possible, in which the location of the male and female fittings is switched between toothbrush implement 102 and canister 104.

The outlet or dispenser port 144 of canister 104 is defined by the projection feature that forms the male fitting 146 at the upper end 142 of canister 104. While the inlet or supply port 134 formed at the lower end 132 of canister 104 is sealed by the use of an accessory item in the form of plug 136, the outlet or dispenser port 144 disposed at the upper end 142 of canister 104 is sealed by the threaded engagement between the female fitting 126 of toothbrush implement 102 and the male fitting 146 of canister 104 (which defines the dispenser port 144). The recess that defines the female fitting 126 of toothbrush implement 102 terminates at an end 129. Accordingly, when the male fitting 146 of canister 104 is threaded into the female fitting 126 of toothbrush implement 102 (thereby assembling canister 104 and toothbrush implement 102), the end or terminus 129 of female fitting 126 effectively covers the mouth of dispenser port 144 (formed by male fitting 146) and acts as a seal to keep the contents in canister 104 from exiting via dispenser port 144.

Figure 3:
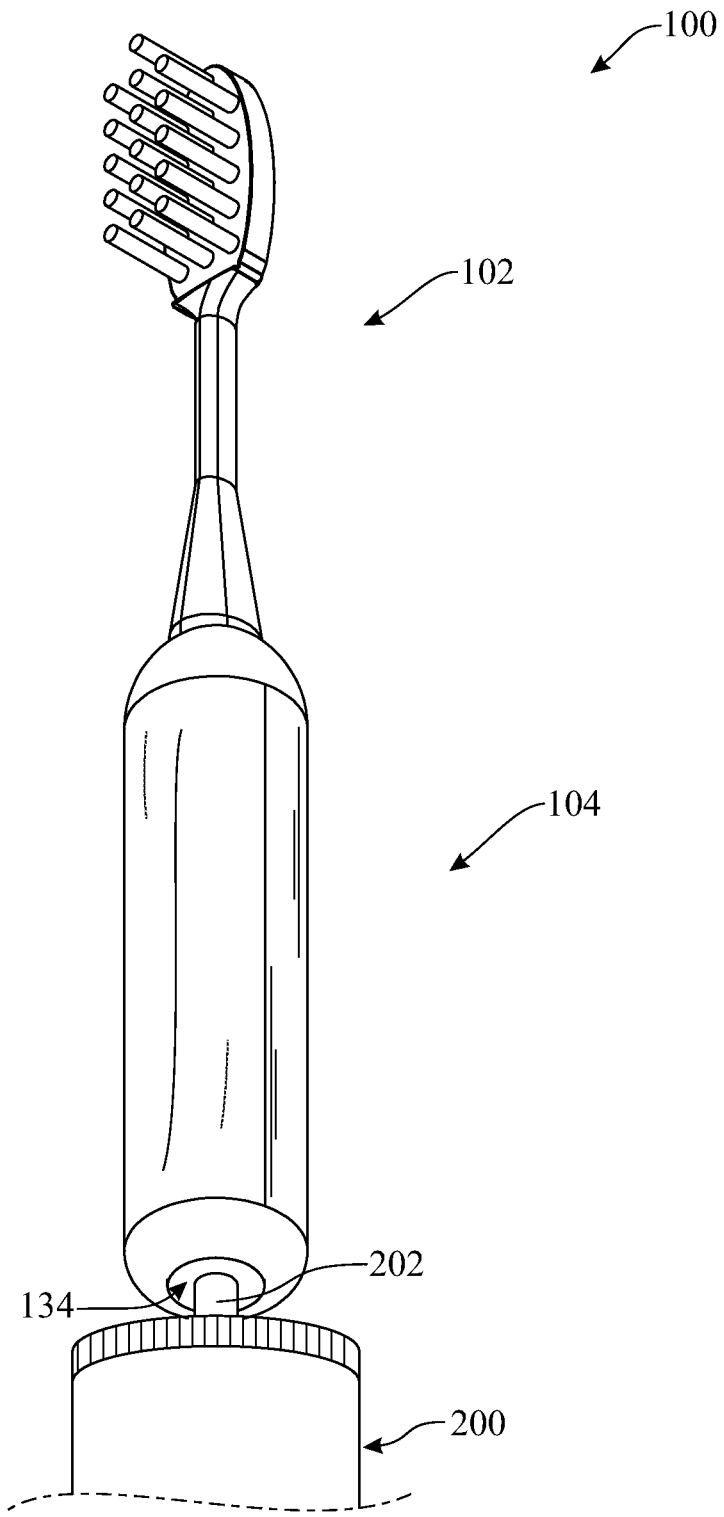
FIG. 3 presents a perspective view of the first embodiment of the toothbrush article of the present invention, illustrating a process for how the article is resupplied with a dental hygiene product.

Referring now to FIG. 3, the canister 104 of toothbrush assembly 100 is supplied with material to fill internal compartment 140 using a suitable bottle or container 200 of relevant material, such as toothpaste. This supply (or re-supply) process occurs when toothbrush assembly 100 is in its assembled configuration, i.e., canister 104 is connected to toothbrush implement 102. The container 200 is provided with a discharge port 202 through which the contents of container 200 are discharged. In order to facilitate the transfer of material from container 200 to canister 104, the discharge port 202 of container 200 is aligned with and inserted into the inlet supply port 134 formed at the lower end 132 of canister 104. Once this fluid-tight connection is made, material can be transferred from container 200 to the interior compartment 140 of canister 104 via supply port 134. The transfer can be accomplished in any suitable manner, such as by inverting the arrangement depicted in FIG. 3 and/or squeezing the container 200 to urge the discharge of its contents via discharge port 202. The process of supplying the interior compartment 140 of canister 104 with relevant material contents can occur at any stage of deployment, such as to facilitate an original supply of contents into toothbrush assembly 100 or a replenishment of assembly 100 once the contents in compartment 140 have been exhausted or diminished through use.

Figure 4:
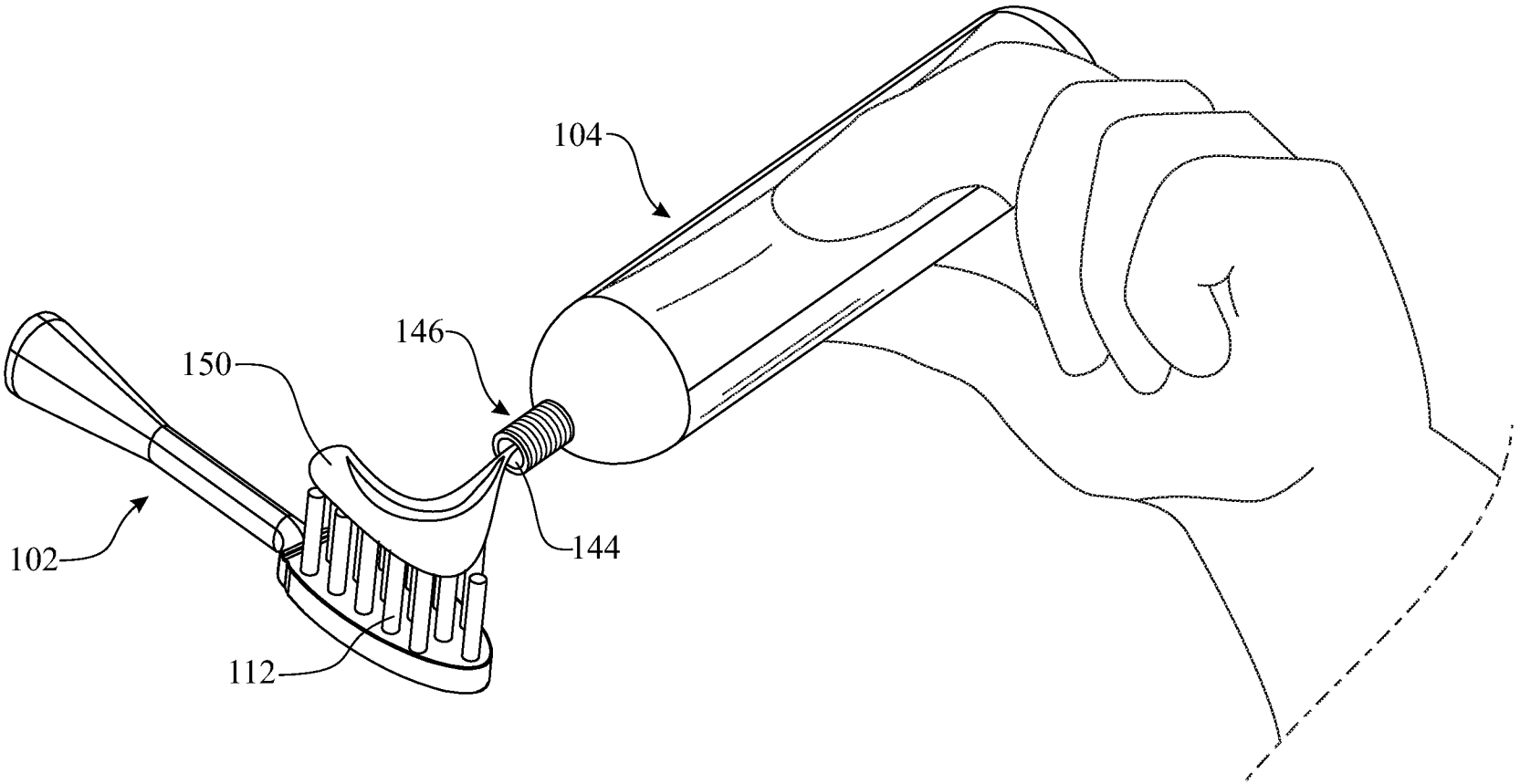
FIG. 4 presents a perspective, disassembled view of the first embodiment of the toothbrush article of the present invention, illustrating a working relationship between the separated components of the article, which depicts one component serving as a toothpaste applicator applying toothpaste to another component serving as a toothbrush implement.

Referring now to FIG. 4, the deployment of canister 104 as an applicator of toothpaste 150, for example, first involves unscrewing or disconnecting canister 104 from toothbrush implement 102. The user then appropriately manipulates canister 104 in order to empty or otherwise dispense at least some of its contents 150 (stored in interior compartment 140) onto the bristles 112 of toothbrush implement 102. In this illustrative application, the contents 150 stored in compartment 140 of canister 104 consist of toothpaste. With the toothpaste 150 now applied, toothbrush implement 102 can be reattached to canister 104 and the teeth brushing operation can commence. In particular, the user maneuvers the toothbrush implement 102 by suitable movements of canister 104, which now functions as a handle grasped by the user in the assembled configuration. One benefit to the dispensing feature shown in FIG. 4, specifically in connection with the utility of canister 104, is that toothbrush assembly 100 offers an all-in-one package to support the teeth cleaning process. First, toothbrush implement 102 provides the tool or bristled cleaning head that performs the brushing operation. Second, canister 104 supplies the material needed to clean teeth, in this case toothpaste 150. The user does not have to keep a tube of toothpaste on hand, since canister 104 furnishes what is needed from the contents of compartment 140. Toothbrush assembly 100 is especially useful during travel because the traveller does not need to bring along a supply of toothpaste separate from whatever is contained in canister 104.

Figure 6:
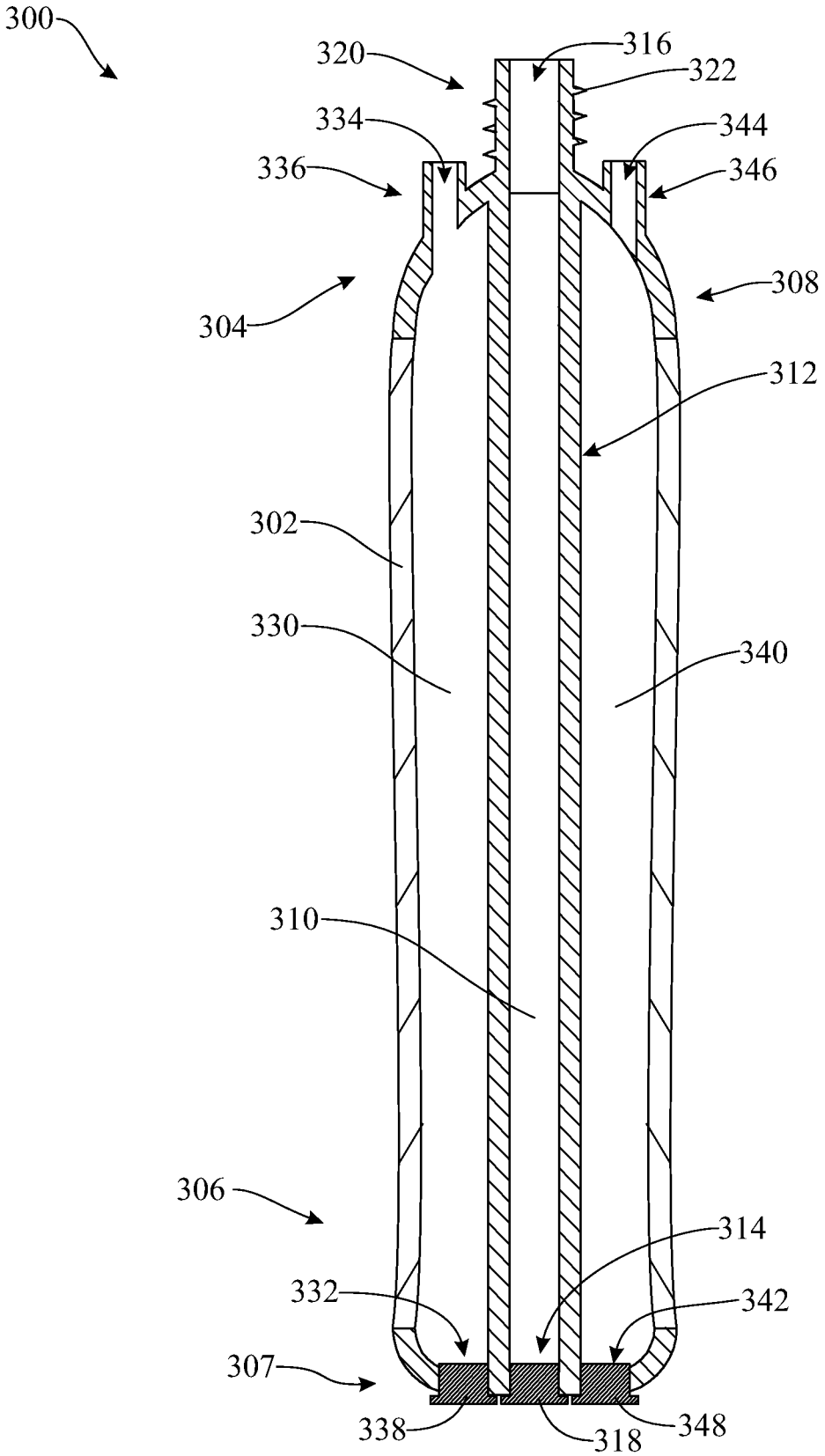
FIG. 6 presents a cross-sectional view of one preferred implementation of the first embodiment of the toothbrush article of the present invention taken along lines 5-5 of FIG. 1, illustrating one way to partition the interior of the canister to form an exemplary arrangement of compartment spaces suitable for storing an assortment of consumable dental hygiene products.

Referring now to FIG. 6, a canister 300 is depicted as an alternate implementation to the canister 104 shown in FIGS. 1-5, according to another aspect of the present invention. While canister 104 employs a single compartment space 140 in its interior, canister 300 has a multi-compartment configuration in which the interior is partitioned into several individual, isolated chambers each capable of containing a distinct and different resource (e.g., toothpaste and several brands of mouthwash). Otherwise, canister 300 integrates with toothbrush implement 102 in the same way that canister 104 does. In this alternative implementation, canister 300 is provided with a set of three (3) isolated interior chambers: central compartment 310 and a pair of side compartments 330, 340. In the configuration shown, the interior chambers are arranged side by side and extend generally axially in the longitudinal dimension of canister 300. The compartments 310, 330, and 340 function to receive, store, and dispense hygiene products or other suitable material, based on user preference, selection, and control. The mutual isolation of the separate compartments 310, 330, 340 prevents mixing or commingling of their contents both during storage and dispensing.

The canister 300 includes an elongate, generally cylindrical or tubular body 302 having a hollow interior, similar to body 130 of canister 104. The body 302 includes an upper end 304 generally defining a location with a set of outlets (discussed further) for dispensing products stored in body 302, and a lower end 306 generally defining a location with a set of inlets (discussed further) for receiving products into the interior compartment spaces of body 302. The interior of body 302 is segregated or partitioned into a set of chambers or compartment spaces 310, 330, 340. In particular, a longitudinal, central interior compartment 310 is defined by the inner cavity space formed by a hollow, generally cylindrical and open-ended inner axial tube 312 that extends axially and continuously between an inlet or supply port 314 disposed at the lower end 306 of canister body 302 and an outlet or dispenser port 316 disposed at the upper end 304 of canister body 302. The central compartment space 310 is open at both ends and extends continuously and fully (coextensively) along the longitudinal dimension of canister body 302. The supply port 314 can be fitted with a suitable removable plug 318 to provide a sealing action once compartment 310 is filled with contents. In one example, plug 318 has a rubber or flexible construction that provides a press fit connection with supply port 314.

The canister body 302 is adapted at its upper end 304 to define an axially extending cylindrical projection or hollow male-type fitting 320 that is provided with a set of external threads 322 at its outer surface. This male-type fitting 320 is similar in construction and functionality to the male fitting 146 of canister 104 (FIGS. 1-5). The dispenser port 316 of central interior compartment 310 is defined by the projection feature that forms this male fitting 320. Canister 300 is coupled to toothbrush implement 102 by a threaded engagement between the male fitting 320 (disposed at the upper end 304 of canister body 302) and the female fitting 126 disposed at the free end 124 of toothbrush implement 102 (FIGS. 2 and 5), in a manner similar to the assembled connection between canister 104 and toothbrush implement 102.

The canister 300 further includes a pair of wing or side interior compartments 330, 340 adjacent the central compartment 310. The annular space surrounding inner tube 312 (which defines central compartment 310) is subdivided or partitioned into the pair of side compartments 330, 340. For purposes of structuring this partition, a radially extending wall (not shown) is formed between inner tube 312 and the inner surface of canister body 302 on both sides, creating a pair of isolated, semi-circular shaped spaces that form the side compartments 330, 340. In a preferred form, side compartments 330, 340 are formed symmetrically about central compartment 310. Each compartment 330, 340 is provided with an inlet/outlet arrangement. In particular, first side compartment 330 includes an inlet 332 (formed at lower end 306 of canister body 302) and an outlet 334 (formed at upper end 304 of canister body 302). The outlet 334 is defined by a projection feature 336 that extends axially from a rounded section 308 at the upper end 304 of body 302. The inlet 332 can be fitted with a removable plug 338, as can outlet 334 (not shown). In a similar fashion, second side compartment 340 includes an inlet 342 (formed at lower end 306 of canister body 302) and an outlet 344 (formed at upper end 304 of canister body 302). The outlet 344 is defined by a projection feature 346 that extends axially from a rounded section 308 at the upper end 304 of body 302. The inlet 342 can be fitted with a removable plug 348, as can outlet 344 (not shown). The inlets 314, 332, 342 of compartments 310, 330, and 340, respectively, are formed at the generally flat bottom side 307 of canister 300. In an alternate deployment of canister 300, the designation of inlets and outlets can be switched, so that the inlets are defined at the upper end 304 of canister body 302 and the outlets are defined at the lower end 306. The various inlets and outlets are provided in fluid communication with their relevant compartment spaces.

In operation, each separate compartment space is filled with different contents, providing the user with a set of distinct hygiene options. For example, each one of the pair of side compartment spaces 330, 340 can be filled with a different type of mouthwash, while central compartment 310 is filled with toothpaste. The contents can be varied from this illustrative example. The contents can be packaged in canister 300 in any manner suitable for use. The available contents in canister 300 can be easily changed by simply emptying the contents and refilling them with desired resources (e.g., hygiene products).

Figure 7:
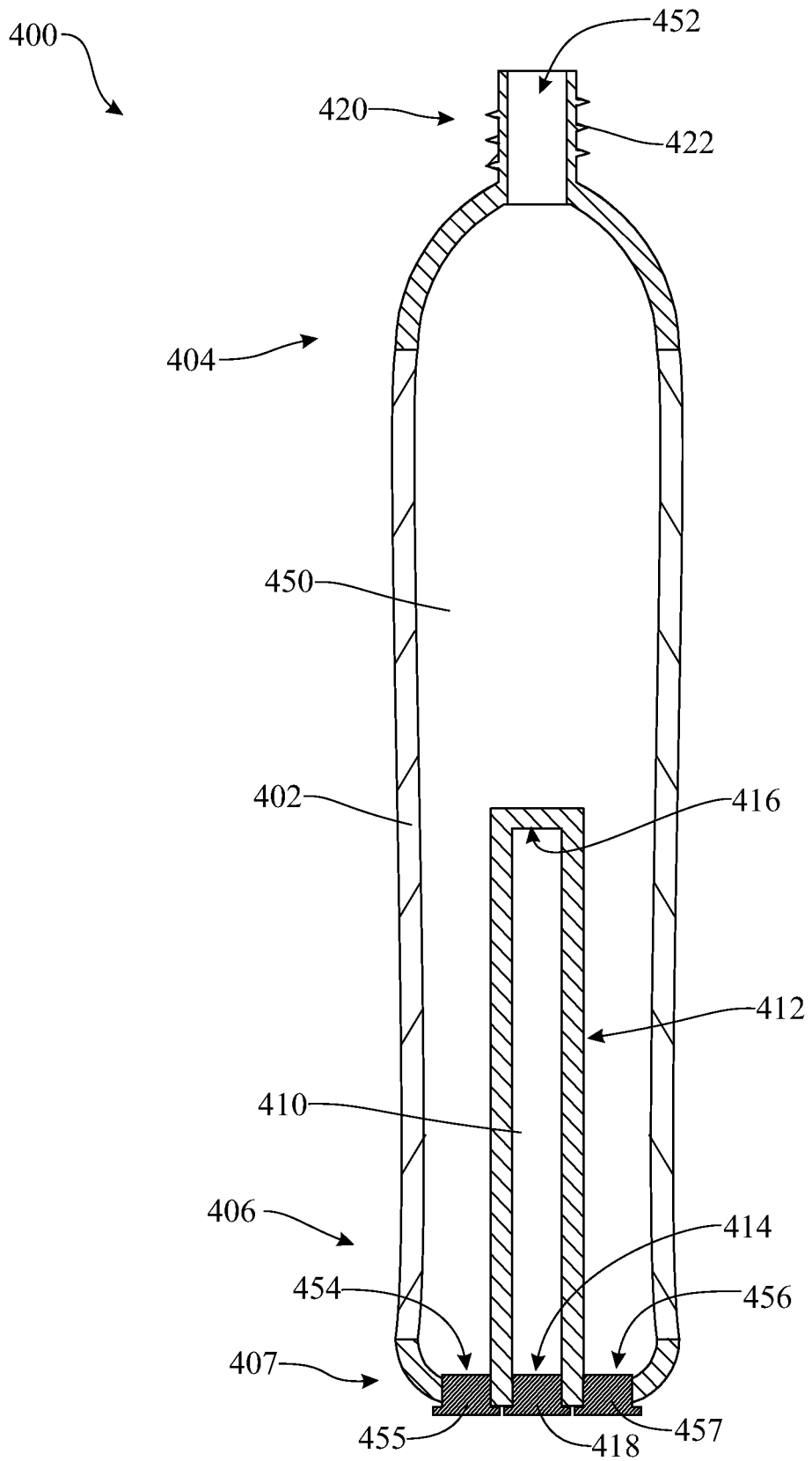
FIG. 7 presents a cross-sectional view of another preferred implementation of the first embodiment of the toothbrush article of the present invention taken along lines 5-5 of FIG. 1, illustrating another way to partition the interior of the canister to form an exemplary arrangement of compartment spaces suitable for storing an assortment of consumable dental hygiene products.
Figure 8:
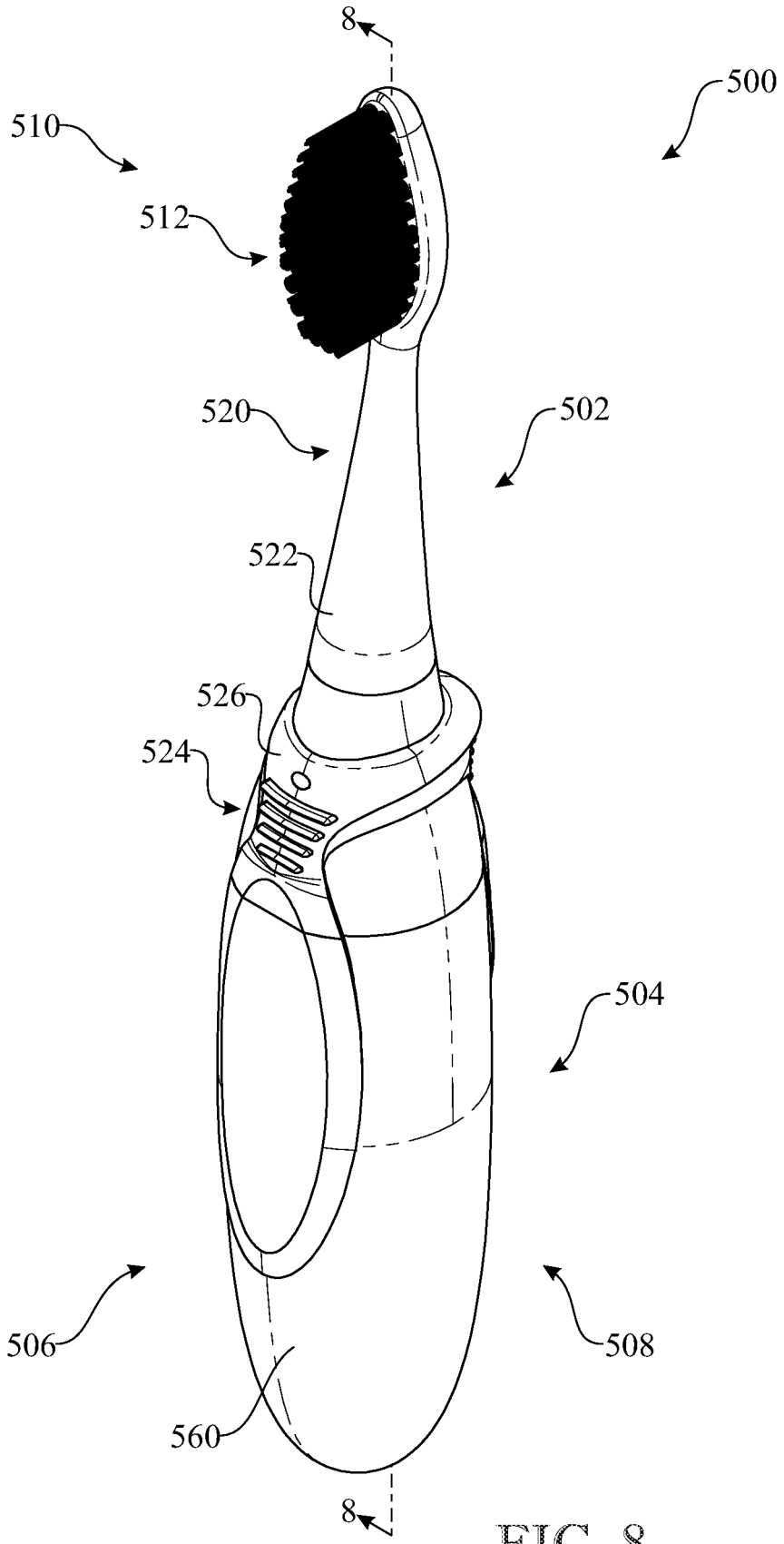
FIG. 8 presents a front perspective view showing a second embodiment of the toothbrush article of the present invention.
Figure 9:
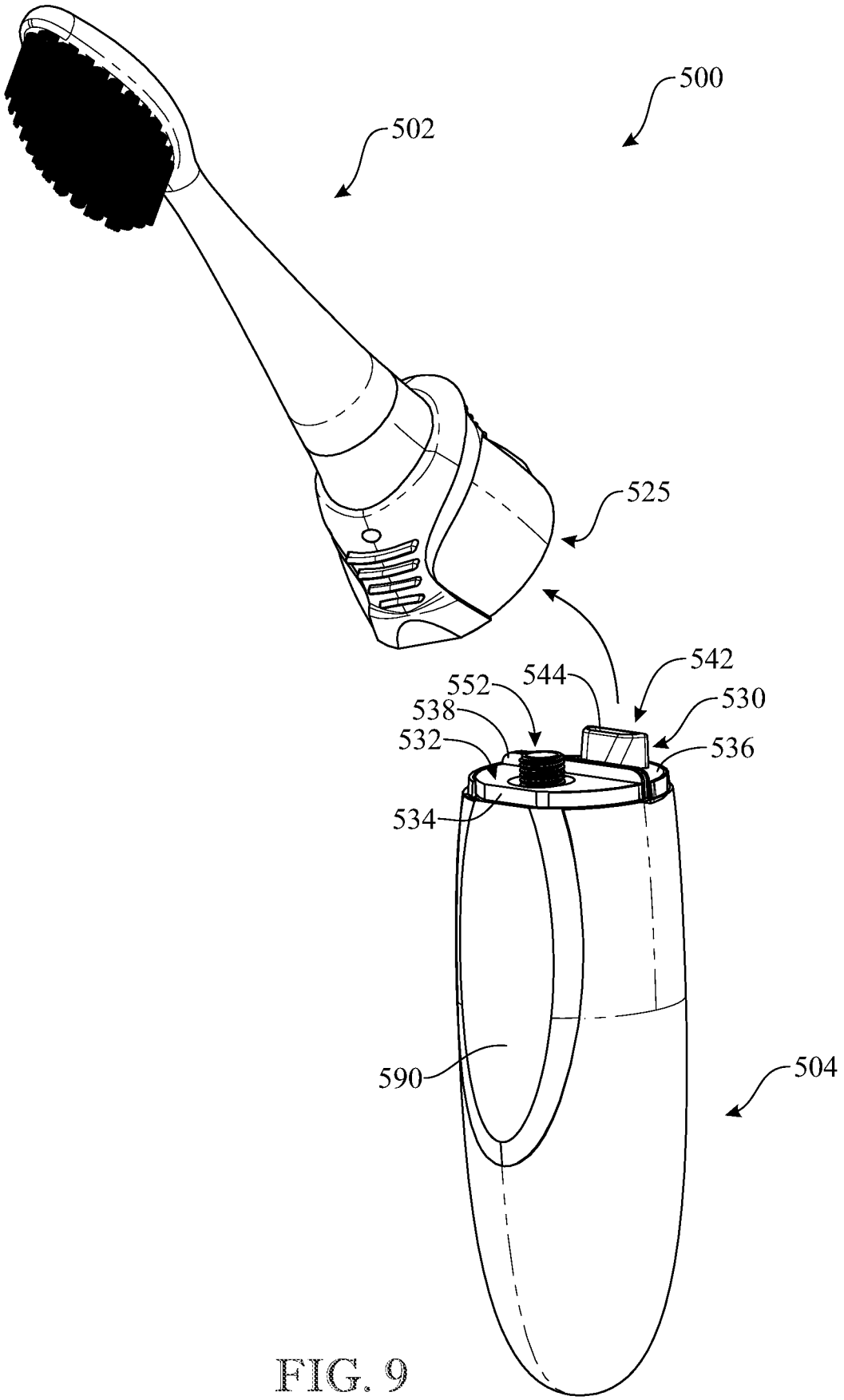
FIG. 9 presents a disassembled front perspective view of the second embodiment of the toothbrush article of the present invention, showing the separation of the upper portion from the lower portion.

Referring now to FIG. 7, a canister 400 is depicted as an alternate implementation to the canister 104 shown in FIGS. 1-5, according to another aspect of the present invention. While canister 104 employs a single compartment space 140 in its interior, canister 400 has a multi-compartment configuration in which the interior is partitioned into several individual, isolated chambers each capable of containing a distinct and different resource (e.g., various toothpaste and mouthwash items). Otherwise, canister 400 integrates with toothbrush implement 102 in the same way that canister 104 does. In this alternative implementation, canister 400 is provided with a set of two (2) isolated interior chambers: a central compartment 410 and a main compartment 450. In the configuration shown, the central compartment 410 extends for a limited distance in the longitudinal direction and the main compartment 450 occupies the rest of the interior space. The compartments 410, 450 function to receive, store, and dispense hygiene products or other suitable material, based on user preference, selection, and control. The mutual isolation of the separate compartments 410, 450 prevents mixing or commingling of their contents both during storage and dispensing.

The canister 400 includes an elongate, generally cylindrical or tubular body 402 having a hollow interior, similar to body 130 of canister 104. The body 402 includes an upper end 404 and a lower end 402 having a generally flat bottom side 407. The interior of body 402 is segregated or partitioned into a set of chambers or compartment spaces 410, 450. In particular, a central compartment 410 is defined by the inner cavity space formed by a hollow, generally cylindrical and closed inner axial tube 412 that extends axially from an opening or orifice 414 disposed at the bottom side 407 of canister body 402 and terminates at a terminus or closed end 416 located partially along the longitudinal dimension of canister body 402. Because compartment 410 has a closed end 416, the orifice 414 functions as both an inlet and outlet for compartment 410. The orifice 414 can be fitted with a suitable removable plug 418 to provide a sealing action once compartment 410 is filled with contents. In one example, plug 418 has a rubber or flexible construction that provides a press fit connection with orifice 414.

The canister 400 further includes a main compartment or chamber 450 that occupies the remaining interior space of body 402 surrounding inner axial tube 412. The canister body 402 is adapted at its upper end 404 to define an axially extending cylindrical projection or hollow male-type fitting 420 that is provided with a set of external threads 422 at its outer surface. This male-type fitting 420 is similar in construction and functionality to the male fitting 146 of canister 104 (FIGS. 1-5). The projection feature that forms this male fitting 420 defines the dispenser port or outlet 452 of main compartment 450. Canister 400 is removably coupled to toothbrush implement 102 by a threaded engagement between the male fitting 420 (disposed at the upper end 404 of canister body 402) and the female fitting 126 disposed at the free end 124 of toothbrush implement 102 (FIGS. 2 and 5), in a manner similar to the assembled connection between canister 104 and toothbrush implement 102. The main compartment 450 of canister 400 is provided with a set of inlet ports or openings 454, 456 defined at the bottom side 407 of canister body 402. These openings 454, 456 define optional or alternative access ways through which contents can be supplied into main compartment 450. The openings 454, 456 are fitted with respective removable plugs 455, 457 to seal main compartment 450.

Although FIGS. 5*a*, 6 and 7 depict different configuration for organizing and partitioning the interior space of the canister body, and thereby forming different arrangements of individual compartments spaces or chambers, these depictions are for illustrative purposes only and should not be construed in limitation of the present invention. Rather, it is considered within the scope of the invention that the interior space of the canister body can be partitioned into any suitable configuration and number of discrete, isolated chambers each having a dedicated assignment of inlet(s) and outlet(s). For this purpose, any suitable form of partitioning structure can be deployed to configure the interior cavity space of the canister body.

Figure 10:
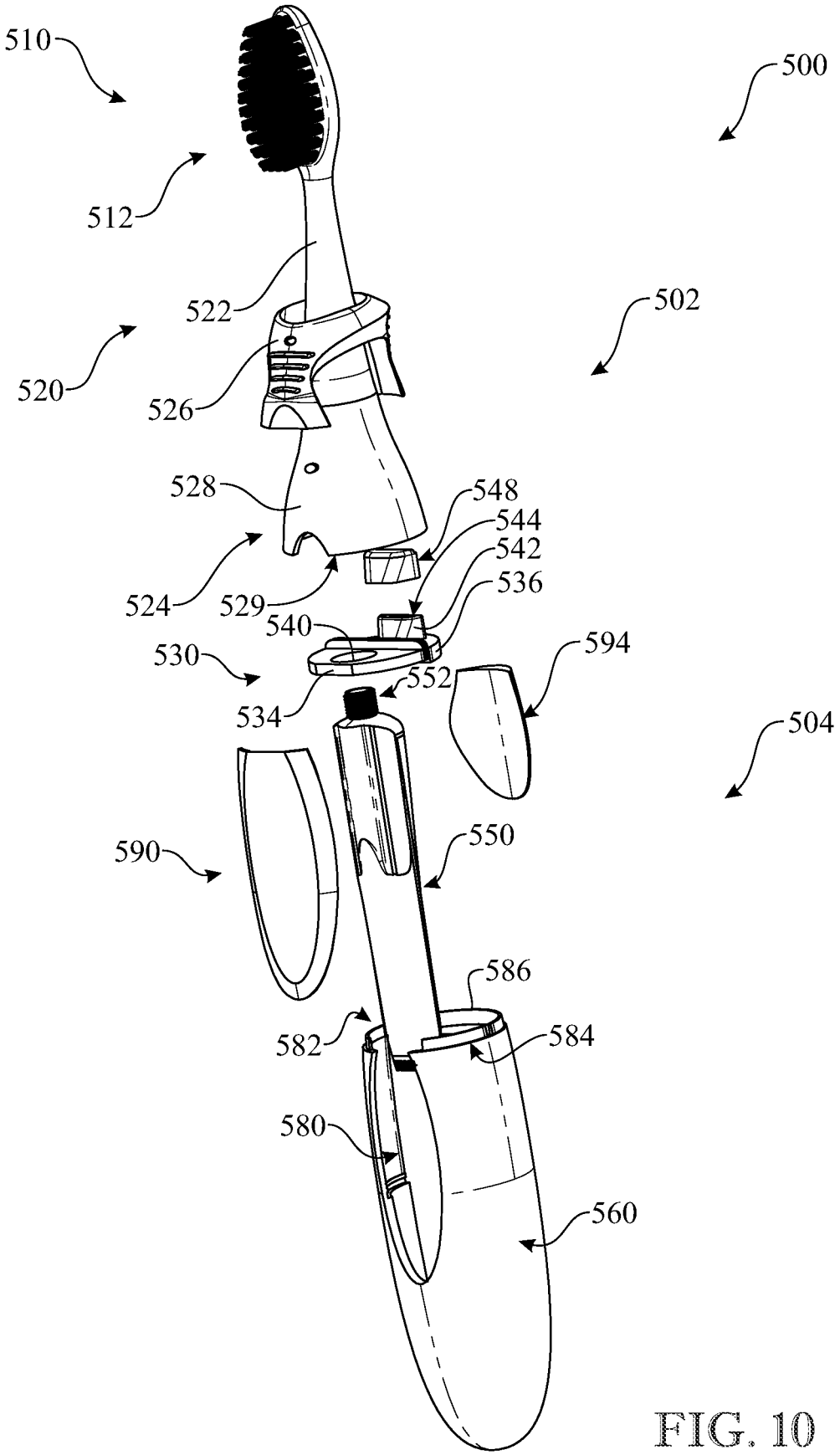
FIG. 10 presents a front exploded perspective view of the second embodiment of the toothbrush article of the present invention.
Figure 11:
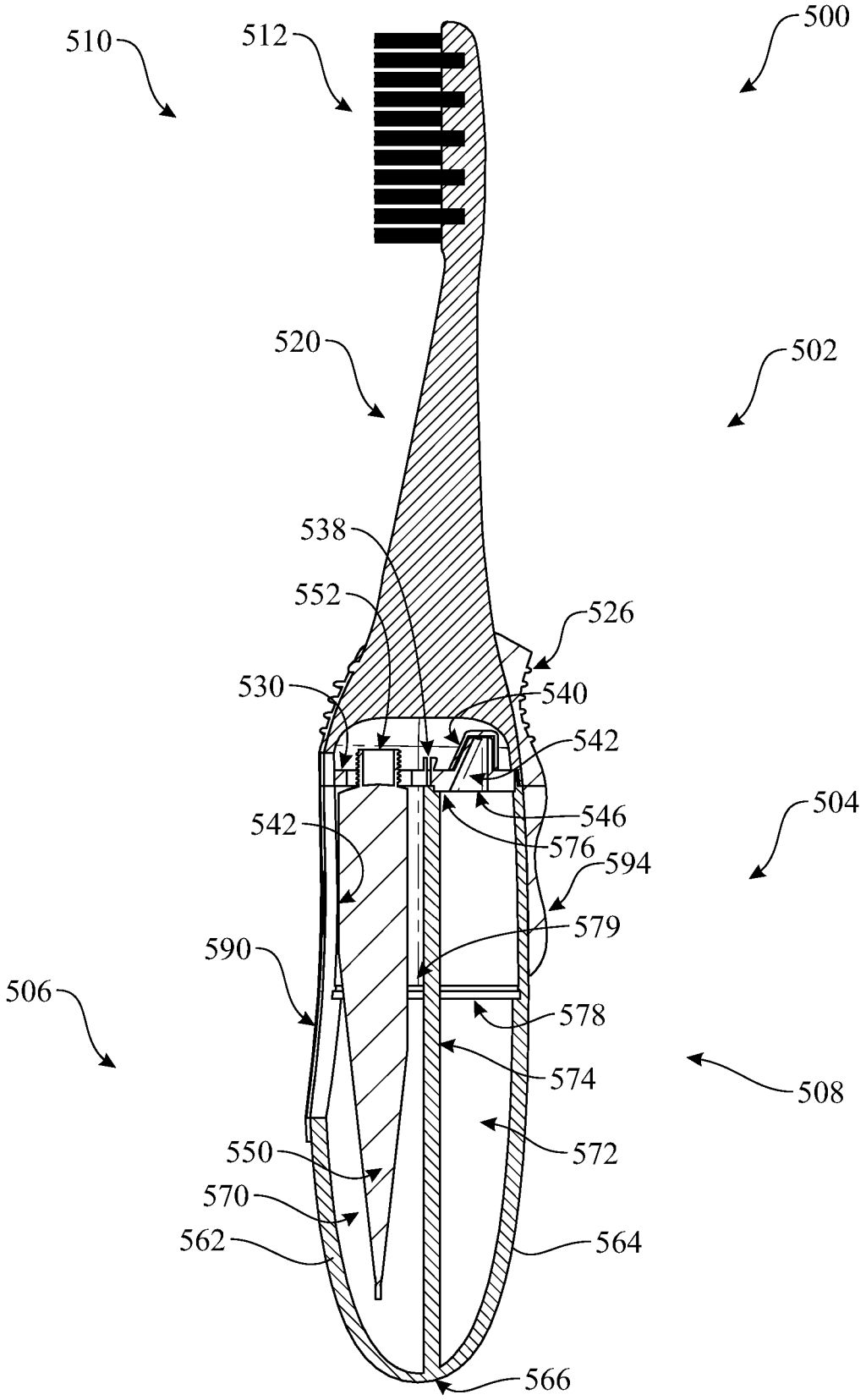
FIG. 11 presents a cross-sectional view of the first embodiment of the toothbrush article of the present invention taken along lines 8-8 of FIG. 8, illustrating the interior compartment spaces configured to contain a toothpaste tube and a mouthwash receptacle.

Referring to FIGS. 8-11, a toothbrush assembly 500 is disclosed, according to a second embodiment of the present invention. The toothbrush assembly 500 includes, in combination, a toothbrush implement or article 502 and a receptacle or container 504, which are removably attached to one another to form a single unit. The toothbrush assembly 500 includes a front side generally illustrated at 506 and an opposing rear side generally illustrated at 508. The toothbrush implement 502 defines a top or upper end of assembly 500, while receptacle 504 defines a bottom or lower end of assembly 500. The toothbrush implement 502 defines the working section or top part of assembly 500. In particular, toothbrush implement 502 incorporates a conventional construction including a head portion 510 having a set of bristles 512. As discussed further, the receptacle or bottom part 504 has a generally hollow-body construction including a front-side interior compartment space 570 configured to receive, support and hold a tube of toothpaste 550, and a rear-side interior compartment space 572 configured to receive, store and dispense an amount of fluid such as mouthwash (FIG. 11). The bottom receptacle 504 also functions as the handle portion for a user to manipulate toothbrush assembly 500 in a conventional fashion to perform a dental cleaning operation (i.e., brush teeth). The toothbrush assembly 500 has a mechanical construction that is operated and otherwise maneuvered by the user in a manual way.

Referring to the top part of toothbrush assembly 500, the toothbrush implement 502 includes a shank or neck 520 having an elongate body 522 that connects the bristle-bearing head 510 to a base 524 where attachment is made to receptacle 504. The base 524 defines a lower free end of implement 502 available for mating attachment to a complementary upper free end 582 of receptacle 504. The base 524 includes an enlarged body 528 having a lower side generally illustrated at 525 (FIG. 9), which defines a generally circular or annular bottom edge generally illustrated at 529 (FIG. 10). The bottom edge 529 includes an axially extending peripheral or circumferential recess or channel that defines a female feature, which seatably receives a complementary, male-type, circular projecting lip 586 that extends axially from the upper edge 584 of upper end 582 of receptacle 504, to form a releasable snap-fit or press-fit connection between the top part (toothbrush implement 502) and bottom part (receptacle 504) (FIG. 10). The toothbrush implement 502 is fitted with a slidable and removable top grip feature 526 that is located in a collar-type or sleeve-type manner about the base 524 of shank 520. In a preferred form, the top grip feature 526 conventionally includes a set of raised grip marks located at the front and rear sides 506, 508 of toothbrush assembly 500. The top grip feature 526 facilitates securing handling and manipulation of toothbrush assembly 500 at its top portion, namely, toothbrush implement 502. In one form, to improve handling and functionality, the shank 520 has a generally cylindrical shape with a diameter that increases progressively from top to bottom, while the mounting base 524 has a generally cylindrical shape with a diameter that progressively increases in the top to bottom direction. The shape of toothbrush implement 502 should not be considered in limitation of the present invention, as other suitable sizes, shapes, dimensions, and configurations are possible within the scope of the present invention. The toothbrush implement 502 can incorporate a conventional construction well known to those skilled in the art.

Referring to the bottom part of toothbrush assembly 500, the receptacle 504 includes an elongate, generally cylindrical or tubular body 560. The body 560 has a generally hollow body construction including a front half sidewall 562 and an adjoining rear half sidewall 564 that extend from an open, upper or top end 582 to a closed, lower or bottom end 566 having a generally rounded or convex feature. The receptacle 504 further includes an axially extending lateral partition 574 that extends from the lower end 566 to the upper end 582 of receptacle 504 and divides the interior space of hollow body 560 into a pair of isolated interior spaces generally illustrated at front compartment space 570 and rear compartment space 572. In one form, the partition 574 is generally disposed at a midline or central location of tubular body 560, although other locations are possible in consideration of forming the appropriately sized compartment spaces 570, 572. In particular, the partition 574 extends axially from the closed lower end 566 of the bottom part body 560 and is generally coplanar with a coronal plane of the bottom part body 560.

The receptacle 504 further includes a removable lid or cover generally illustrated at 530 that is located during assembly at the upper open end 582 of receptacle 504. The lid 530 has a generally planar, disc-shaped, solid circular body 532 having a toothpaste-dispensing side or section 534 and an adjoining, adjacent mouthwash-dispensing side or section 536. A raised laterally extending feature 538 functions as a separator or divider between lid sections 534, 536. The mouthwash section 536 of lid 530 includes a nipple-type projection 542 located above and disposed in fluid communication with rear compartment space 572. For this purpose, nipple 542 includes an upper orifice or discharge/dispensing port 544 and a lower orifice or opening 546 facing rear compartment space 572. Fluid contents contained within rear compartment space 572 can be dispensed via nipple 542, following the seating of lid 530 on receptacle 504. The mouthwash nipple 542 can have any suitable conventional configuration that is amenable to contact with the mouth/lips of a user and the dispensing of mouthwash via that pathway. A removable cap 548 is provided that fits over and onto the nipple 542 to provide a sealing feature to prevent fluid leakage.

At the toothpaste-dispensing side 534 of lid 530, an orifice, aperture or through-hole 540 is formed in lid body 532. During assembly, a toothpaste tube 550 is axially seated and otherwise located in the front tube-receiving compartment 570. When lid 530 is positioned at the upper end 582 of receptacle 504, the dispensing nipple 552 of toothpaste tube 550 fits through opening 540. Any suitable means can be used to locate and hold toothpaste tube 550 in front compartment space 570. In one form, for example, a lateral support structure generally illustrated at 578 is provided within receptacle body 560, which preferably spans from the front sidewall 562 to the rear sidewall 564. A tube-receiving and holding slot shown generally at 579 is formed in the frontward side of lateral support structure 578. The slot 579 receives toothpaste tube 550 during installation and holds tube 550 in a suspended, carrier-type, holstering fashion. The front sidewall 562 includes a front-facing cutout or opening generally illustrated at 580 that is contiguous with and accessible to the front tube-receiving compartment 570. The opening 580 is fitted with a similarly sized and dimensioned bottom front grip pad 590 that covers opening 580 and may be removable. The front grip pad 590 is appropriately shaped to define an intimate, proximal, immediately adjacent relationship to toothpaste tube 550 when tube 550 is positioned within compartment 570 and the front grip pad 590 is located over opening 580. The relative positioning of bottom front grip pad 590 and toothpaste tube 550 defines an engagement area or clearance 592 between them. The bottom front grip pad 590 is preferably made of a resilient material. During application, the user depresses the bottom front grip pad 590, which causes the front grip pad 590 to moved inward through clearance space 592, contact toothpaste tube 500, and apply sufficient pressure to dispense toothpaste contents from the dispenser nipple 552 of toothpaste tube 550. To facilitate this dispensing operation and reduce the amount of depression needed, the bottom front grip pad 590 may have an inward curving or concave profile. The front opening 580 and compatible bottom front grip pad 590 may have any suitable shape, such as a generally oval or elliptical configuration. The receptacle 504 may optionally be provided with a bottom rear grip pad 594 at the rear side 508 of toothbrush assembly 500 to improve user handling. The bottom front grip feature 590 is configured to define an intimate spaced-apart relationship with a toothpaste tube 550 operably loaded into the tube-receiving front compartment space 570 such that depression of the bottom front grip feature 590 facilitates contact with the toothpaste tube 550.

During the assembly process, with the top part (toothbrush implement 502) and bottom part (receptacle 504) separated, lid 530 is initially removed from its location on receptacle 504. The receptacle 504 is first loaded with dental hygiene products and other such contents. A suitable amount of mouthwash is poured into the rear fluid-receiving compartment 570, filling it to an appropriate level. A tube of toothpaste 550 is loaded into the front tube-receiving compartment 570 in a guided, sliding motion and held in place by lateral support structure 578. If not already installed, the bottom front grip pad 590 is situated into place over the tube-accessible opening 580. The lid 530 is then seated on the open upper end 582 of body 560 of receptacle 504 at a generally concentric, radially inward position relative to the peripheral projection lip 586 extending from the upper edge 584. Any suitable means can be used to locate lid 530 on open upper end 582. In one form, for example, lid 530 can be adapted to securely fit onto the upper end 576 of partition 574. Once seated, lid 530 (at section 536) cooperates with partition 574 and the sidewalls of body 560 to integrally form a closed container, which functions as a fluid-tight compartment space or receptacle 572 to receive and store mouthwash. In particular, the combination of lid 530, partition 574, and receptacle body 560 cooperatively and integrally forms a closed receptacle or reservoir to hold fluid contents. Toothbrush assembly 500 can be configured with various seals disposed at the interfaces and transitions between components to enhance the sealing properties of compartments 570, 572, in a manner well known to those skilled in the art. Cap 548 is secured on fluid-communicating nipple 542 to seal the mouth of fluid-containing compartment 572. In its seated position, lid 530 features the dispenser nipple 552 of toothpaste tube 550 extending through opening 540 formed in lid 530 (at section 534).

At this point, the receptacle or bottom part 504 is ready for attachment to the toothbrush implement or top part 502. The toothbrush implement 502 is mounted to receptacle 504 by joining lower end 525 of toothbrush implement 502 to upper end 582 of receptacle 504. In particular, the annular projecting rim or peripheral lip 586 formed at the terminal upper edge 584 at upper end 582 of bottom part 504 is seated within the annular recess formed in the lower terminal edge 529 at the lower end 525 of top part 502, using a releasable press fit connection. The mounting base 524 of shank 520 of top part 502 is sized and dimensioned cooperatively with the body 560 of lower part 504 so that, following assembly, the respective outer surfaces at the interface between top part 502 and bottom part 504 form a substantially contiguous transition featuring a substantial material continuation.

Following the assembly of top part 502 and bottom part 504 into a single integral unit, toothbrush assembly 500 can be used and otherwise deployed in a conventional manner to brush teeth. Toothpaste and/or mouthwash is available to the user in the form of the contents stored in bottom part 504 of toothbrush assembly 500, which the user can access by removing top part 502 from bottom part 504, dispensing and retrieving toothpaste from toothpaste tube 550 by adequately depressing bottom front grip pad 590 to squeeze out contents from nipple 552, and receiving mouthwash supplied from the rear fluid-receiving compartment (reservoir) 572 via nipple 542.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A toothbrush assembly, consisting of:

a top part including an elongate body and a toothbrush bristle head; and a bottom part releasably connected to the top part, the bottom part including:

a one-piece elongate hollow body having an open upper end and a closed lower end, the closed lower end being free of any openings, the body defining an interior space, the body having a front half sidewall and a rear half sidewall, a partition that includes a vertically extending wall extending laterally from a side portion to an adjacent side portion of the hollow body and extending from the closed lower end of the bottom part of upwardly toward the open upper end, the partition disposed in the hollow body and dividing the interior space into a tube-receiving front compartment space and a fluid-receiving rear compartment space, an opening in the open upper end formed in the front half sidewall and communicating with the front compartment space, a lid removably located on the bottom part body at the upper end thereof, the lid including a front section having a nipple-receiving aperture disposed in communication with the front compartment space, the lid including a rear section having a nipple projection disposed in fluid communication with the rear compartment space, and a bottom front grip feature carried by the bottom part body and disposed over the opening formed in the front half sidewall, and a toothpaste tube positioned within the tube-receiving front compartment of the bottom part of the toothbrush article, the toothbrush tube including a dispensing nipple freely extending through the nipple-receiving aperture of the lid and in uncoupled relation to the top part, wherein the bottom front grip feature is configured to define an intimate spaced-apart relationship with the toothpaste tube in the tube-receiving wherein the top part includes first mating structure and the bottom part includes second mating structure, the first mating structure consisting of one of a rib or a recess, the second mating structure consisting of the other of the rib or the recess, the rib and the recess configured to form a snap fit between the top part and the bottom part of the container to releasably secure the first part to the second part front compartment space such that depression of the bottom front grip feature causes direct contact with the toothpaste tube to at least partially compress the toothbrush tube to displace toothpaste and cause dispensing of the toothpaste onto the toothbrush bristle head of the toothbrush implement via the nipple of the toothpaste tube when the toothbrush implement is released from the container, and wherein the top part includes first mating structure and the bottom part includes second mating structure, the first mating structure consisting of one of a rib or a recess, the second mating structure consisting of the other of the rib or the recess, the rib and the recess configured to form a snap fit between the top part and the bottom part of the container to releasably secure the first part to the second part.

2. The assembly as recited in claim 1, wherein the toothbrush implement including a head and a shank extending from the head, the shank having a bottom free end.

3. The assembly as recited in claim 2, wherein the bottom free end of the shank further includes a terminal peripheral bottom edge having a recess formed therein.

4. The assembly as recited in claim 3, wherein the open upper end of the bottom part body includes a terminal peripheral upper edge having a peripheral lip projecting therefrom.

5. The assembly as recited in claim 4, wherein the top part and the bottom part are connected together by seating the lip projecting from the terminal peripheral upper edge of the open upper end of the bottom part body within the recess formed in the terminal peripheral bottom edge of the bottom free end of the toothbrush implement shank.

6. The assembly as recited in claim 4, wherein the lid is disposed at a location generally concentric and radially inward of the lip projecting from the terminal peripheral upper edge of the open upper end of the bottom part body.

7. The assembly as recited in claim 1, wherein the bottom part body is configured to receive and support the toothpaste tube in a manner such that the nipple of the toothpaste tube extends through the nipple-receiving aperture of the lid.

8. The assembly as recited in claim 1, wherein a combination of the rear section, the partition, and the rear half sidewall define a fluid-tight receptacle.

9. The assembly as recited in claim 1, wherein the partition is configured at an upper end thereof to support the lid.

* * * * *